US007401941B2

(12) United States Patent
Teng et al.

(10) Patent No.: US 7,401,941 B2
(45) Date of Patent: Jul. 22, 2008

(54) FLASHLIGHT

(75) Inventors: Cheng-I Teng, Taichung County (TW); Yen-Chieh Huang, Changhua County (TW)

(73) Assignee: Mobiletron Electronics Co., Ltd., Taichung Hsien (TW)

( * ) Notice: Subject to any disclaimer, the term of this patent is extended or adjusted under 35 U.S.C. 154(b) by 1 day.

(21) Appl. No.: 11/182,758

(22) Filed: Jul. 18, 2005

(65) Prior Publication Data

US 2007/0014103 A1 Jan. 18, 2007

(51) Int. Cl.
*F21L 4/00* (2006.01)
*F21L 4/02* (2006.01)
*F21V 1/00* (2006.01)

(52) U.S. Cl. ..... 362/197; 362/184; 362/236; 362/239; 362/240

(58) Field of Classification Search ..... 362/194, 362/191, 177, 197, 199, 382, 207, 208, 190, 362/183–186, 235–236, 239, 396
See application file for complete search history.

(56) References Cited

U.S. PATENT DOCUMENTS

| | | | | | |
|---|---|---|---|---|---|
| 4,225,906 | A * | 9/1980 | Gulliksen et al. | ..... | 362/254 |
| 5,558,430 | A * | 9/1996 | Booty, Jr. | ..... | 362/184 |
| 5,971,562 | A * | 10/1999 | Yang | ..... | 362/184 |
| 5,988,828 | A * | 11/1999 | Prince et al. | ..... | 362/191 |
| 6,158,874 | A * | 12/2000 | Brustein et al. | ..... | 362/184 |
| 7,246,927 | B2 * | 7/2007 | Wikle et al. | ..... | 362/396 |

* cited by examiner

*Primary Examiner*—Sandra L. O'Shea
*Assistant Examiner*—Sean P Gramling
(74) *Attorney, Agent, or Firm*—Bacon & Thomas, PLLC

(57) ABSTRACT

A flashlight includes a main member having top, a bottom, a front and a rear. The main member has a base a head and battery pack, wherein the head is pivoted on the base via a pivot to be flexed to the front. A first light source and a second light source are mounted on the head, wherein the second light source projects light that is substantially to that of the first light source. A hook is provided in a tunnel in the base to be drawn out or pushed into. The first and second light sources and the flexion of the head provide a greater illumination range and a function of adjusting the illuminating direction when it is hung.

7 Claims, 5 Drawing Sheets

FLASHLIGHT

BACKGROUND OF THE INVENTION

1. Field of the Invention

The present invention relates generally to an illuminating device, and more particularly to a flashlight with greater illumination range and capable of changing the illuminating direction when it is hung.

2. Description of the Related Art

A conventional flashlight to illuminate narrow workplace includes a handle, a shell on an end of the handle, a wire with a plug on the other end of the handle and a light bulb in the shell. The shell includes a plate and a metallic net. The shell protects the light bulb and lets the light emitting out via the net. The flashlight usually is provided with a hook on the shell or on the handle, such that workers may hang the flashlight on a wall or other suitable place to work with both hands. As long as the flashlight is hung on a place, the orientation of illumination is fixed. To adjust the orientation of illumination of the flashlight, worker has to hang the wire on another place to lean the flashlight. If there were no suitable place to hang the wire, the flashlight cannot illuminate the desire place. Furthermore, the wire always slips because there is no device on the wire for hanging.

SUMMARY OF THE INVENTION

The primary objective of the present invention is to provide a flashlight, which has a greater illumination range.

The second objective of the present invention is to provide a flashlight, which is capable of changing the illuminating direction when it is hung.

According to the objective of the present invention, a flashlight comprises a main member having top, a bottom, a front and a rear. The main member has a base and a head, wherein the head has an end pivoted on an end of the base via a pivot to be flexed and extend relative to the base. A first light source and a second light source are mounted on the head, wherein the second light source projects light that is substantially to that of the first light source. A hook is provided on the base.

DETAILED DESCRIPTION OF THE INVENTION

Figure 1:
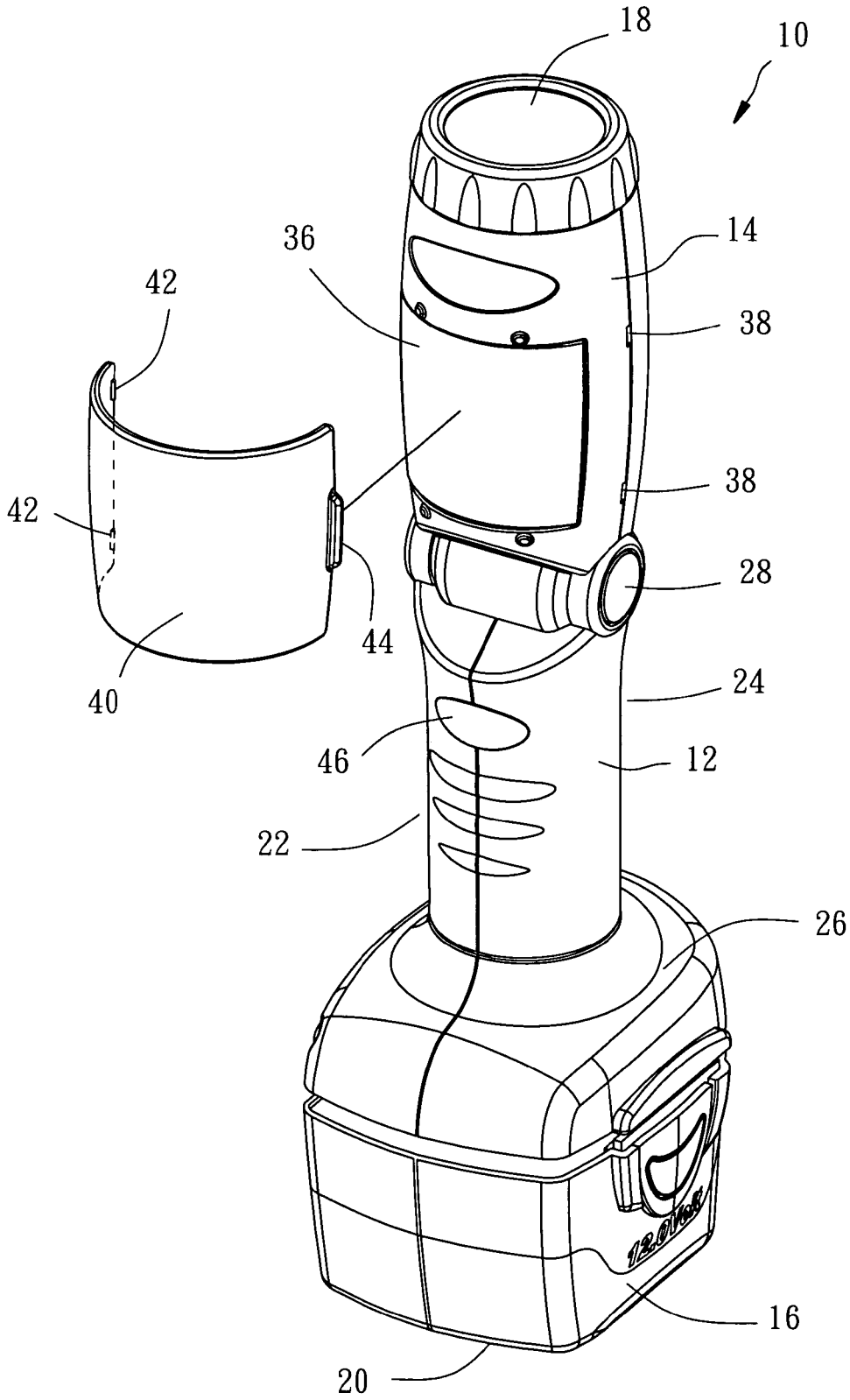
FIG. 1 is an exploded view of a preferred embodiment of the present invention.
Figure 2:
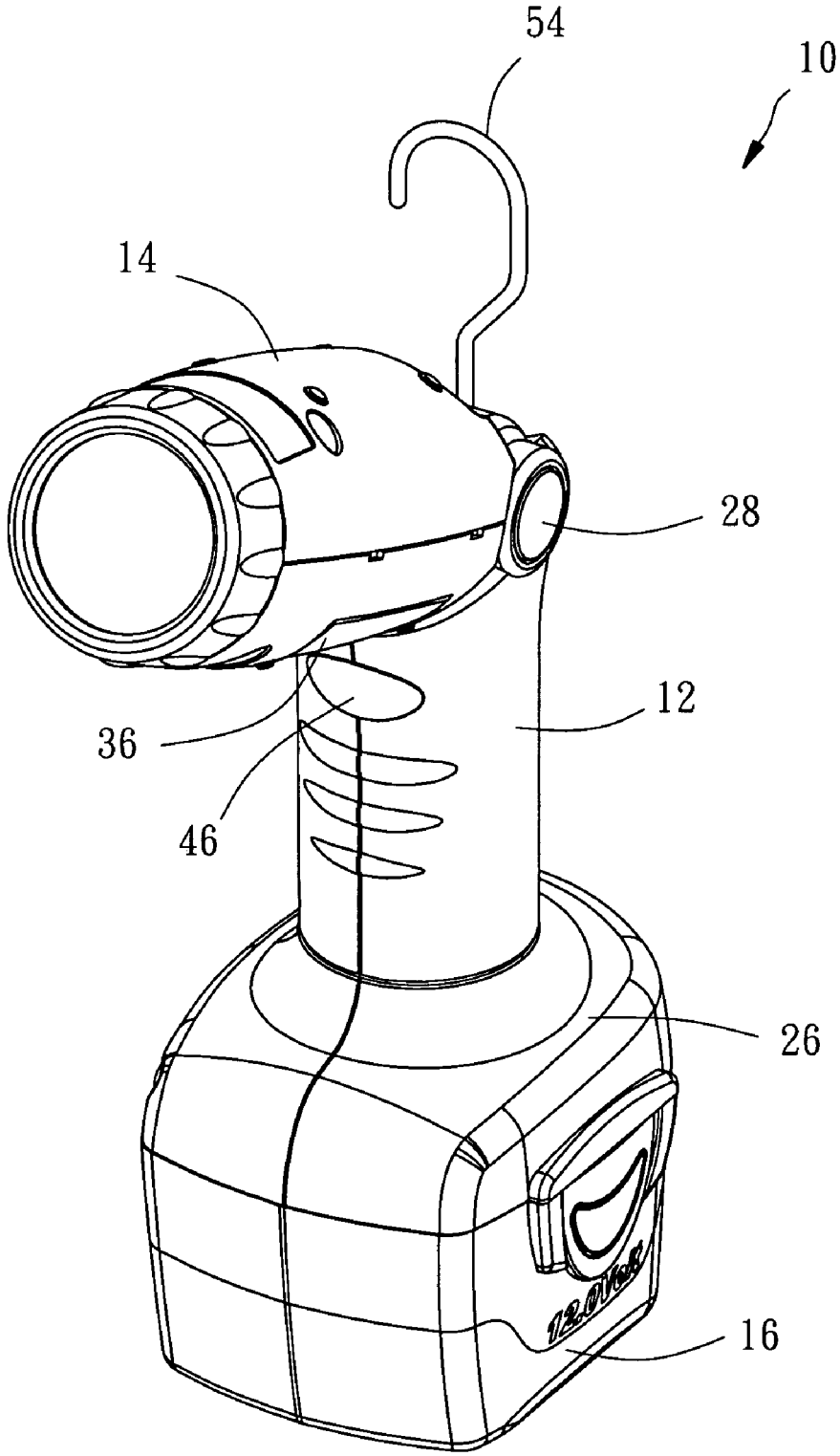
FIG. 2 is a perspective view of the preferred embodiment of the present invention, showing the head being flexed and the hook being drawn out.

As shown in FIG. 1 and FIG. 2, a flashlight of the preferred embodiment of the present invention comprises:

A main member 10, which is consisted a base 12, a head 14 and a battery pack 16, has a top 18, a bottom 20, a front 22 and a rear 24. The base 12 has a connector portion 26 at an end thereof to be coupled with the battery pack 16. The battery pack 16 has rechargeable batteries therein and has a flat bottom at the bottom 20 of the main member 10, such that the main member 10 can stand on a surface.

Figure 3:
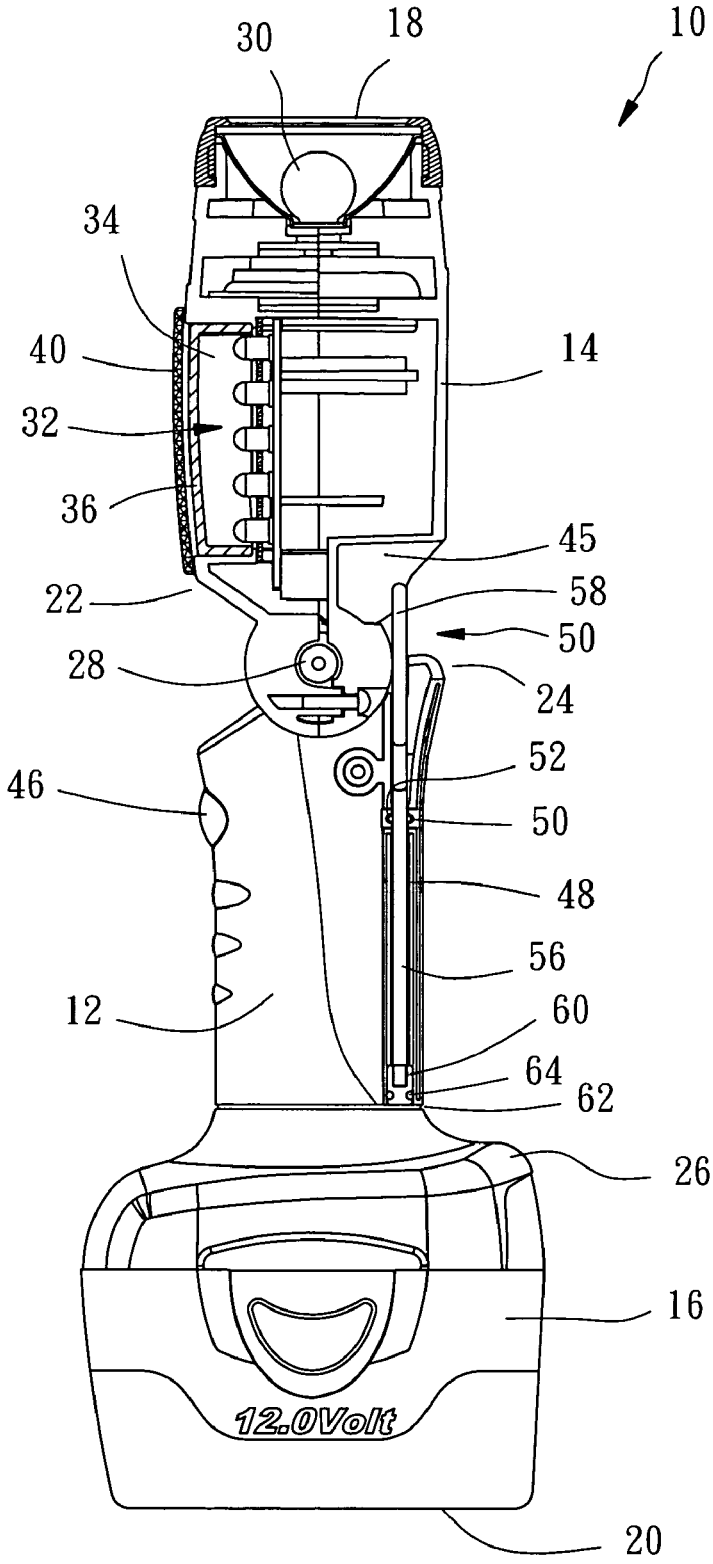
FIG. 3 is a sectional view of the preferred embodiment of the present invention, showing the head being extended.
Figure 4:
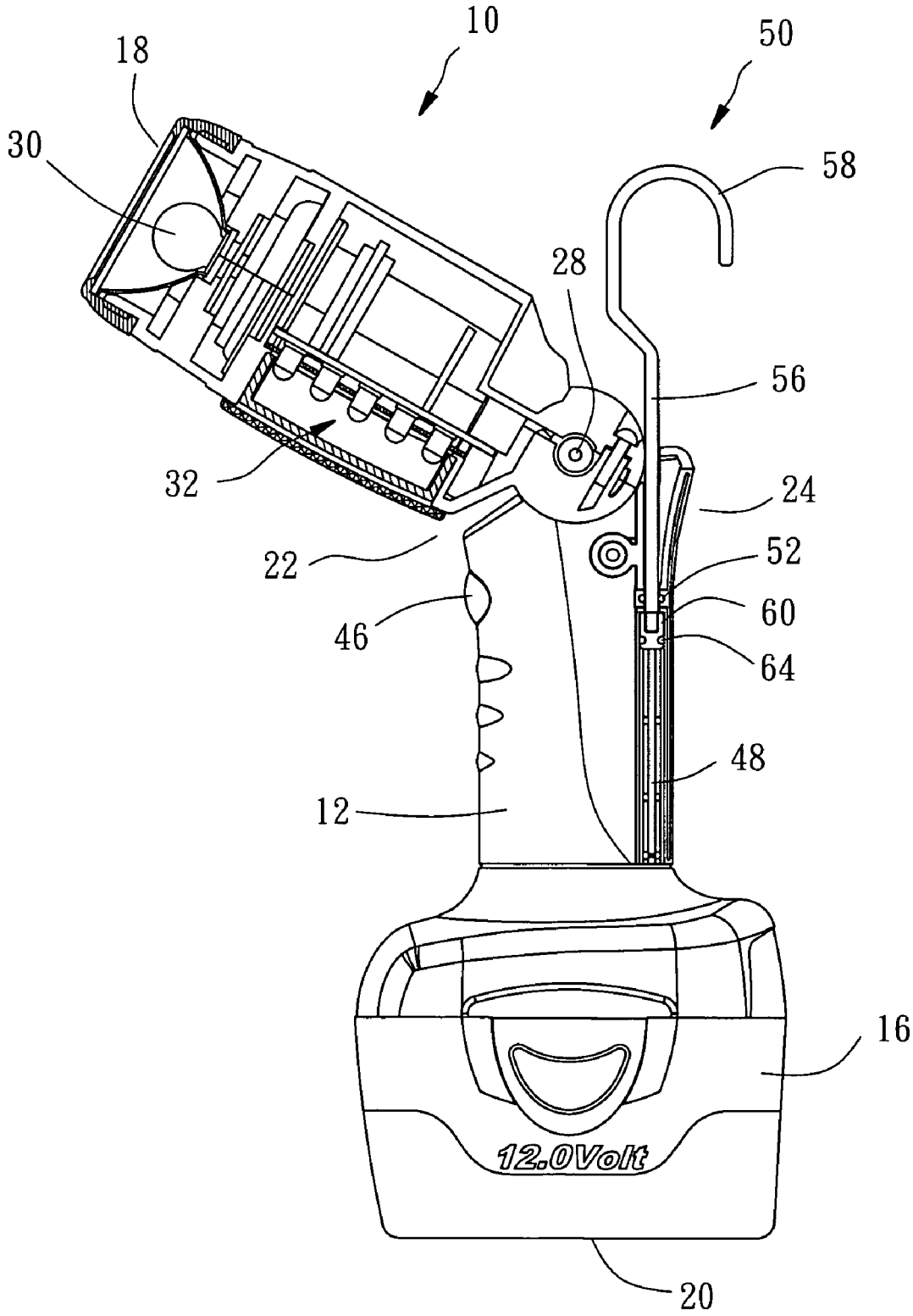
FIG. 4 is a sectional view of the preferred embodiment of the present invention, showing the head being flexed.

The head 14 has an end pivoted on an end of the base 12, opposite to the battery pack 16, via a pivot 28, such that the head 14 can be flexed to the front 22 of the main member 10 about sixty degrees (FIG. 2 and FIG. 4). As shown in FIG. 3 and FIG. 4, the head 14 has a first light source 30 and a second light source 32. The first light source 30 has a light bulb at the top 18 of the head 14, and the second light source 32 includes five light emitting diodes (LEDs) in a cavity 34 at the front 22. A transparent lid 36 is mounted in cavity 34 to cover the LEDs 32. The head 14 has four apertures 38 at the opposite sides of cavity 34. A curved optical film 40, which a curvature thereof is fitted to that of the head 14, has four block 42 at an interior side thereof and a protrusion 44 at an exterior side thereof. The optical film 40 is detachably fixed on the head 14 by engagement of the block 42 and the apertures 38 to cover the lid 36 and by exerting the protrusion 44 to take it off. The optical film 40 has a predetermined color to change the color of illumination of the LEDs 32. Of course, the optical film 40 may have other optical functions, such as diffusion, focus etc. The head 14 has a recess 45 at the rear 24 adjacent to the pivot 28.

The base 12 is provided with a switch 46 to turn the first and second light sources 30 and 32 on and off respectively. As shown in FIG. 3 and FIG. 4, the base 12 further has a tunnel 48 at the rear 24 and parallel to the rear 24, which has an opening beside the pivot 28. On a sidewall of the tunnel 48, an annular slot 50 is provided, in which an O-ring 52 is received. A hook 54 has a straight section 56, a hook portion 58 and a plug 60 connected to an end of the straight section 56. The plug 60 has an annular slot 62, in which an O-ring 64 is received. The straight section 56 and the plug 60 are received in the tunnel 48 of the base 12 to be drawn out of or pushed into the tunnel 48. The hook portion 58 is left out of the tunnel 48 while the straight section 56 is totally received in the tunnel 48, and it has a portion received in the recess 45 of the head 14 when the head 14 is extended.

In use, the head 14 is flexed first to draw the hook 54 out. The hook 54 can be rotated to hang the flashlight of the present invention on a predetermined place, such as a wall or a car hood. And then, turn the first light source 30 or the second light source 32 on (or turn both of then on) and flex or extend the head 14 to project light from the first or second light source 32 to a predetermined place. The light projected from the first light source 30 is particular to that of the second source that provides a greater illumination range of the flashlight of the present invention. For example, when the second light source 32 is turned on and the head 14 is flexed as shown in FIG. 2 and FIG. 4, the flashlight can illuminate downwards. As a result, the flashlight of the present invention has an illumination range about 150 degrees.

To store the flashlight, the hook 54 is pushed into the tunnel 48 first, and then extends the head 14 to the vertical place, wherein the exposed hook portion 58 of the hook 54 is received in the recess 45 of the head 14, such that the flashlight is minimized in size for storage and carry, as shown in FIG. 3.

Figure 5:
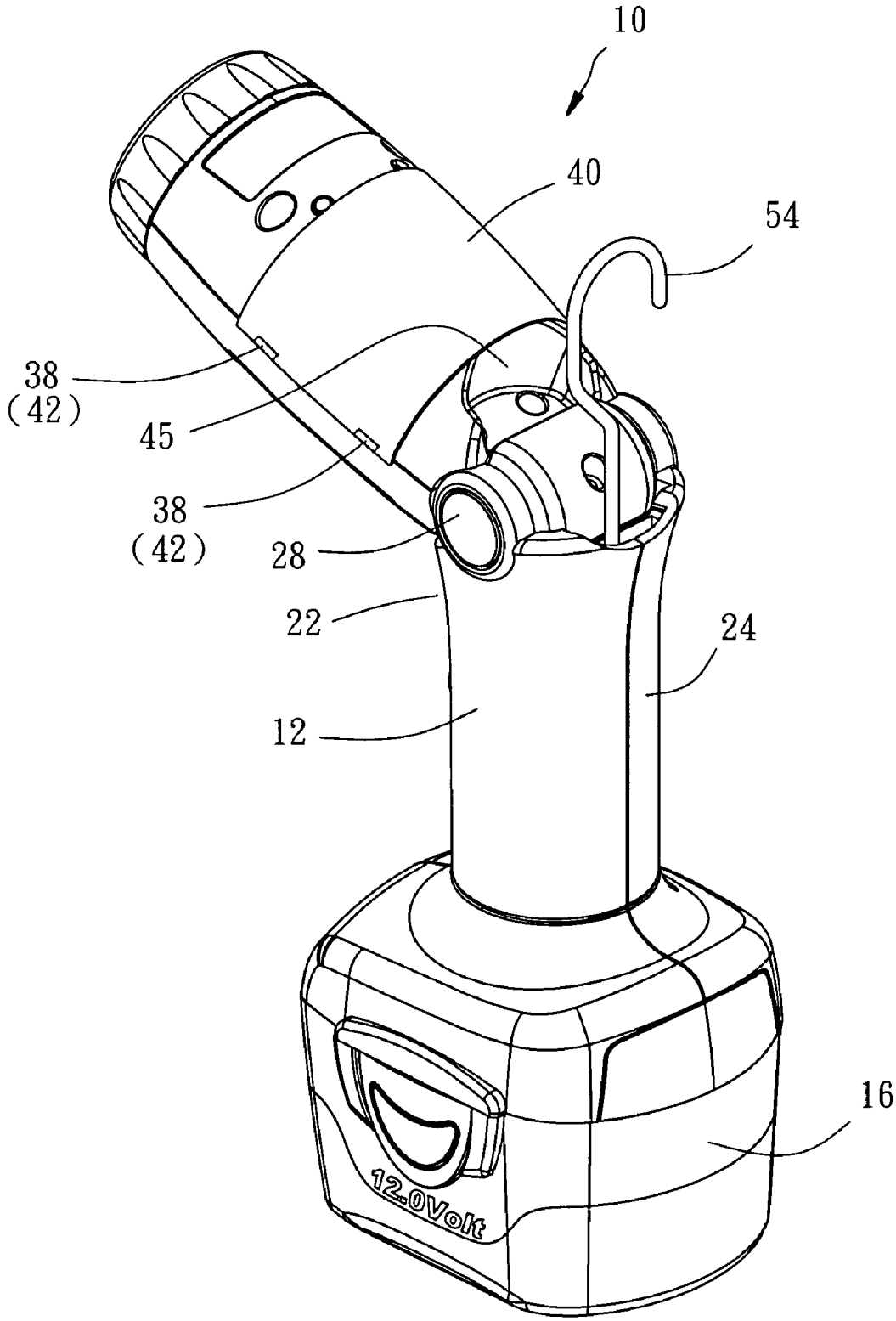
FIG. 5 is a perspective view of the preferred embodiment of the present invention, showing the optical film being mounted on the rear of the head.

When user needs color light, the optical film 40 is mounted on the head 14 to cover the lid 36 by the engagement of the block 42 and the apertures 38. When user needs white light, as shown in FIG. 5, the optical film 40 is taken off and mounted on the rear 24 of the head 14 still by the engagement of the block 42 and the apertures 38 that prevents the optical film 40 from missing.

The flashlight of the present invention may provide a wire with a plug for replacement of the battery pack.

What is claimed is:

1. A flashlight, comprising:

a main member, which has a top, a bottom, a front and a rear; having a base and a head, wherein the head has an end pivoted on an end of the base via a pivot to be flexed and extend relative to the base;

a first light source mounted on the head;

a second light source mounted on the head to project light that is substantially perpendicular to that of the first light source;

a hook provided on the base; and an optical film detachably mounted on the head to cover the second light source;

wherein the base is provided with a tunnel, in which the hook is received to be drawn out of or pushed into the tunnel; and wherein the hook has a portion left out of the tunnel when the hook is pushed into the tunnel, and the head has a recess at the rear to receive the portion of the hook.

2. The flashlight as defined in claim 1, wherein the base is provided with a ring in a recess on a sidewall of the tunnel to be fitted to the hook, the hook further having a ring against the sidewall of the tunnel.

3. The flashlight as defined in claim 2, wherein the hook is provided with a plug received in the tunnel, on which a slot is provided on the plug to receive the ring of the hook therein.

4. The flashlight as defined in claim 1, wherein the head is provided with apertures, and the optical film is provided with blocks to be engaged with the apertures respectively.

5. The flashlight as defined in claim 4, wherein the blocks of the optical film are engaged with the apertures of the head while the optical film is attached on the head from the front of or from the rear.

6. The flashlight as defined in claim 1, wherein the optical film has a protrusion on an exterior side.

7. The flashlight as defined in claim 1, further comprising a ring located in a recess on a sidewall of the tunnel to be fitted to the hook, the hook being provided with a ring against the sidewall of the tunnel.

* * * * *